United States Patent [19]

Leutenegger et al.

[11] 3,957,429

[45] May 18, 1976

[54] PROCESS FOR THE PRETREATMENT OR FINISHING OF MATERIALS WITH APPLICATION OF A SHORT LIQUOR RATIO

[75] Inventors: Willi Leutenegger, Bottmingen; Jakob Bühler, Muttenz; Jürgen Markert, Basel; Jacques Zurbuchen, Pratteln, all of Switzerland

[73] Assignee: Ciba-Geigy Corporation, Ardsley, N.Y.

[22] Filed: June 18, 1974

[21] Appl. No.: 480,455

[30] Foreign Application Priority Data

June 28, 1973 Switzerland ..... 9421/73

[52] U.S. Cl. ..... 8/169; 8/73; 8/74; 8/94 A; 8/172 R

[51] Int. Cl.[2] ..... D06P 5/04

[58] Field of Search ..... 8/169, 172, 73, 74, 8/94

[56] References Cited

UNITED STATES PATENTS

| | | | |
|---|---|---|---|
| 3,701,625 | 10/1972 | Sieber | 8/94 |
| 3,792,977 | 2/1974 | Guenthner | 8/172 |
| 3,806,315 | 4/1974 | Rosenbaum et al. | 8/94 |

*Primary Examiner*—Lewis T. Jacobs
*Attorney, Agent, or Firm*—Joseph G. Kolodny; Edward McC. Roberts; Prabodh I. Almaula

[57] ABSTRACT

A process is described for the pretreatment or finishing of materials with processing agents dissolved or dispersed in water or in organic solvents, wherein the portion of the treatment liquor or of the pretreatment liquor containing the processing agent constitutes the volumetrically smaller part, and the remaining portion of this treatment liquor consists of at least one inert organic compound selected from a water-insoluble, aliphatic, cycloaliphatic and aromatic compound which is perfluorinated or mixed-halogenated, or which contains a perfluorinated or mixed-halogenated radical which compounds are immiscible with the treatment liquor; and wherein the liquor optionally contains additional auxiliaries that do not form an emulsion with the inert organic compound, and the system is very thoroughly mixed during the pretreatment or finishing process.

12 Claims, No Drawings

PROCESS FOR THE PRETREATMENT OR FINISHING OF MATERIALS WITH APPLICATION OF A SHORT LIQUOR RATIO

The invention relates to a process for the pretreatment and finishing of materials with application of a short ratio of goods to liquor, to the pretreatment or finishing liquor, as well as to the material pretreated or finished by this process.

The advantages of dyeing with, inter alia, a short goods-to-liquor ratio (by which is meant a weight ratio between the material to be dyed and the dye liquor of about 1:1 to 1:5) are known to those skilled in the art.

It is thus suggested in DOS No. 2,145,827 that fibre material be dyed in short liquors in the presence of a stable microfoam, the purpose of the foam being to promote penetration of the material by the dye liquor and to ensure uniform distribution of the liquor within the material being dyed.

A further mode of application for short liquors is one whereby the dye liquor in the treatment chamber is applied in the form of a spray, i.e. in the form of a finely divided dispersion of the liquor in the air, and the material is simultaneously kept in motion in this chamber during the time of application of the whole amount of liquor.

Mechanical factors, however, limit the possibilities of application of the mentioned processes. The field of application of these processes is restricted generally to treatment machines in which a vigorous movement can be imparted to the material being dyed; this applies particularly to drum dyeing machines. On the other hand, however, this mode of treatment is not possible with apparatus in which the material to be treated remains stationary while the treatment liquor is being circulated; this is the case, for example, in circulation dyeing machines for loose material and yarn balls, and also in beam dyeing machines for piece goods.

Also known is the treatment of textile materials in liquors consisting of emulsions of water in chlorinated hydrocarbons, e.g. tetrachloroethylene, whereby the dyestuffs, auxiliaries or finishing agents are contained in the water phase of the system, which is small compared with the total volume of the treatment bath. This is in principle likewise a short-liquor process which however, in contrast to the previously described short-liquor technique for operating on a purely aqueous basis, may also be employed in treatment apparatus operating according to the circulation principle. But this type of procedure too has considerable disadvantages, such as, e.g. the disadvantage that, to ensure adequate emulsion stability, it is necessary - depending on substrate and apparatus - to add a relatively large amount of emulsifiers, a factor which greatly influences the costs; and that the employed treatment liquors have in each case to be distilled in order to separate the applied organic solvent from water and emulsifier to effect the recovery of the solvent.

A process rendering unnecessary the use of emulsifers in the treatment of textiles in mixtures of water and halogenated hydrocarbons is described by S. Rosenbaum in Textile Research Journal 1972, from p. 238. According to this, the employed organic phase of the treatment bath is a mixture of tetrachloroethylene with a nonhalogenated aliphatic hydrocarbon, e.g. a petroleum fraction. The mixture ratio of the two components is so adjusted that the density of the mixture corresponds to that of water at the dyeing temperature. Under these conditions, the water phase is in a fine suspension in the dye bath, without the water phase needing to be emulsified. On cooling of the treatment liquor, the organic phase precipitates, since its density increases with falling temperature - in consequence of the higher thermal expansion coefficent - to a greater extent than that of water. Apart from the fact that combustible organic solvents are used in this process, which during application appreciably increases the danger factor, there is the risk with this type of procedure that additions of surface-active auxiliaries lead to an emulsion being formed, thus rendering difficult, if not impossible, a separation of the organic phase. Furthermore, the solubility of, e.g. disperse dyestuffs in mixtures of tetrachloroethylene and a hydrocarbon is high enough to colour the organic phase to such an extent that it cannot be used for a further dyeing operation without distillation or some other form of purification.

All textile treatments which are carried out at elevated temperature, and which involve the use of a treatment liquor consisting to an appreciable extent or entirely of halogenated hydrocarbons, have the further disadvantage that they unfavourably affect, to a greater or lesser extent, the handle of all textiles.

This affecting of the handle varies greatly. In the case of wool, such treatments lead to practically the complete removal of the fat; and in the case of vegetable fibres to the partial removal of the natural waxes. And very varying effects on the handle, depending on the type of fibre or fibre preparations, have been observed with synthetic substrates.

Moreover, such treatments result in a 'fibre-specific' retention of the employed solvent in the substrate.

Without subsequent steaming with saturated steam - or heat treatment of the dyed substrates for an appreciable length of time at a temperature above the boiling point of the applied solvent - there occurs in the case of practically all fibres, as a result of the retention of solvent in the substrates, an impairment, to a greater or lesser extent, of the fastness to light. Hence it is necessary with application of chlorinated hydrocarbons to carry out one or other of the mentioned aftertreatments. A complete removal of the solvent from the fibres becomes imperative, however, also for physiological and economic reasons.

The new finishing process according to the invention, described in the following, now renders possible, with, at the same time, avoidance to a great extent of the disadvantages of treatment processes in a medium containing a halogenated hydrocarbon, the application of short treatment liquors also in finishing machines in which the liquor circulates and the material being treated remains stationary. The process according to the invention is suitable for the pretreatment or finishing of materials with use of a short liquor ratio and with processing agents dissolved or dispersed in water or in organic solvents, and is characterised in that the portion of the treatment liquor or of the pretreatment liquor containing the processing agent constitutes the volumetrically smaller part, and the remaining portion of the said treatment liquor consists of at least one inert organic compound which is immiscible with the treatment liquor and liquid at the processing temperature; and that the liquor optionally contains additional auxiliaries that do not form an emulsion with the inert organic compound, and the system is very thoroughly mixed during the pretreatment or finishing process.

The preferred mode of application of the new process is based on the use of the smallest possible amount of a treatment medium, whereby the weight ratio of the material to be treated to the treatment medium (ratio of goods to liquor) is preferably about 1:0.5 to 1:5, particularly 1:1 to 1:3, and a larger amount of an organic-chemically inert compound, which is governed by the volume of the machine. The treatment medium, in which the processing agents to be applied are dissolved or dispersed, consists preferably of water; it can however also be an organic solvent, provided that this is immiscible, or miscible only in very small proportions, with the inert compound forming the main portion of the treatment liquor; or it can be a mixture of water and an organic solvent of the said kind. Such organic solvents are, in particular, mono- and polyvalent alcohols such as methanol, isopropyl alcohol, benzyl alcohol and ethylene glycol monoethyl ether (cellosolve), or halogenated hydrocarbons, especially perchloroethylene.

The amount of treatment liquor depends on, among other things, the absorptive capacity of the substrate.

Suitable organic chemically inert compounds are those which are not only hydrophobic but also organophobic, i.e. which have practically no affinity for water or for organic solvents, such as miscibility or mutual solubility.

Compounds having these properties are water-insoluble, aliphatic, cycloaliphatic and aromatic compounds which are perfluorinated or mixed-halogenated, or which contain a perfluorinated or mixed-halogenated radical.

To be mentioned among such compounds are: perfluorinated aliphatic hydrocarbons having at least 8 carbon atoms, such as perfluorooctane, perfluorodecane or perfluorododecane, as well as the commercial perfluorokerosenes of the average composition $C_nF_{2n+2}$, wherein $n$ is 12 to 25, which have a mean molecular weight of 600 to 1400.

Also suitable are tertiary aliphatic amines, such as perfluorotri-n-propylamine, perfluoro-tri-n-butylamine, perfluoro-tri-n-pentylamine and perfluorotri-n-octylamine; then, perfluorinated cycloaliphatic compounds, such as perfluoro(1,3-dimethyl)-cyclohexane, or cycloaliphatic amines such as perfluorocyclohexylamine, and perfluorinated cycloaliphatic ethers such as those of the formula

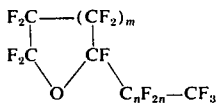

wherein $m$ can vary between 1 to 8, and $n$ between 1 and 4, such as, e.g. the cycloaliphatic ether of the formula $C_8F_{16}O$; and perfluorinated cycloaliphatic compounds, such as perfluorodecalin and perfluoro-(1-methyl-decalin).

A variation of these compounds can be obtained in the case where the carbon chain is interrupted by hetero atoms, such as nitrogen or sulphur and particularly oxygen. Resulting compounds are, e.g. those of the formula $$CF_3\text{-}O\text{-}(CF_2\text{-}(CF_2\text{-}O)_n\text{-}CF_3$$

and $$CF_3\text{—}S\text{—}CF_2\text{—}(CF_2)_n\text{—}\underset{\underset{X}{|}}{CF}\text{—}CF_3,$$

wherein X = F, Cl or - depending on the mode of preparation - compounds such as $$F\text{—}(\underset{\underset{CF_3}{|}}{CF}\text{—}CF_2\text{—}O)_n\text{—}\underset{\underset{X}{|}}{CF}\text{—}CF_3,$$

wherein X = F, $CF_3$ whereby $n$ is so chosen that the boiling points of the resulting compounds are preferably between 100 and 220°C, e.g. where $n$ is 4, a perfluorinated alkylpolyether having a boiling point of 194°C.

To be included herein are also compounds containing, besides the perfluorinated radical, a classical organic functional group. Compounds of this type are, e.g. the technically easily obtainable perfluorinated derivatives of phosphoric acid, sulphonic acid and, above all, carboxylic acid, whereby those in particular that can be used are the perfluorinated carboxylic acid esters of the formula

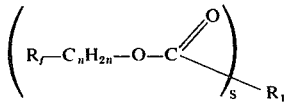

wherein $R_f$ represents a straight-chain or branched-chain perfluoroalkyl radical having 4 to 16 carbon atoms, $R_1$ represents an aliphatic or ethylene-bound hydrocarbon radical of organic mono-, di- or tribasic carboxylic acids having 1 to 6 carbon atoms, $n$ denotes an integer from 1 to 3, and $s$ an integer to the value of 1 to 3.

A further embodiment can comprise esterification also of perfluorinated carboxylic acids of the chain length $C_4$-$C_{16}$ with mono- or bivalent lower alcohols, such as, e.g. perfluoro-n-hexane-α-carboxylic acid esters $C_6F_{13}$-COOM, perfluoro-n-heptane-α-carboxylic acid esters $C_7F_{15}$-COOM, perfluoro-n-octane-α-carboxylic acid esters $C_8F_{17}$-COOM, and/or perfluorinated sulphonic acid esters, such as, e.g. perfluoro-n-hexane-α-sulphonic acid esters $C_6F_{13}$-$SO_3M$, perfluoro-n-heptane-α-sulphonic acid esters $C_7F_{15}$-$SO_3M$, or perfluoro-n-octane-α-sulphonic acid esters $C_8F_{17}$-$SO_3M$, whereby M can be the radical of a primary or secondary alcohol having 1 to 6 carbon atoms, such as methanol, ethanol, n-proponal, i-propanol or n-butanol, or a fluorinated alcohol such as, e.g. trifluoroethanol, $CF_3$-$CH_2$-OH, pentafluoropropanol-1 $CF_3$-$CF_2$-$CH_2$-OH, n-heptafluorobutanol-1 $CF_3$-$CF_2$-$CF_2$-$CH_2$-OH, 1,1,3-trihydroperfluoropropanol-1 $CF_2H$-$CF_2$-$CH_2$-OH, 1,1,5-trihydroperfluoropentanol-1 $CF_2H$-$CF_2$-$CF_2$-$CF_2$-$CH_2$-OH, 3,3,4,4,5,5,5-heptafluoropentanol-2

$$CF_3\text{—}CF_2\text{—}CF_2\text{—}\underset{\underset{OH}{|}}{CH}\text{—}CH_3,$$

3,3,4,4,4-pentafluorobutanol-2

$$CF_3\text{—}CF_2\text{—}\underset{\underset{OH}{|}}{CH}\text{—}CH_3$$

or an alcohol of the formula $CF_3$-$CF_2$-$CH_2$-$CH_2$-NH-$CH_2$-$CH_2$-OH.

These compounds are described, for example, in the work of L. Lichtenberger "Lés dérivés des fluorocarbures" in 'Chimie et Industrie', Vol. 104, pp. 815 to 825 (1971).

In the case of the mixed-halogenated compounds, a part of the fluorine atoms can be replaced by other halogen atoms, such as, e.g. bromine or chlorine. Compounds of this type are the linear addition polymers of trifluorovinyl chloride, resulting in the formation of compounds of the formula

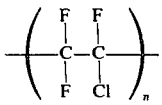

whereby $n$ is so chosen that the mean molecular weights of the compounds obtained are between 560 and 1250.

Of special interest are perfluorinated aliphatic or cycloaliphatic compounds containing at least 8 carbon atoms, such as perfluorinated tri-n-butylamine, perfluorinated cycloaliphatic ethers of the formula $C_8F_{16}O$ and perfluorinated hydrocarbons of the formula $C_nF_{2n+2}$, wherein $n$ is 12 to 25.

The aforementioned compounds are in most cases well-known compounds which are obtainable commercially, such as perfluoroalkylpoly ethers marketed under the name of FREON-E by DuPont, U.S.A.; also available, supplied by the 3M Company, U.S.A., are perfluorinated tri-n-butylamine under the name of FC 43, and perfluorinated cycloaliphatic ethers $C_8F_{16}O$ as FC 75 and FC 77.

A number of commercially obtainable perfluorinated organic compounds are listed in the work of O. Scherer, "Commercial Organic Fluorine Compounds" in the collection "Fortschritte der Chemischen Forschung" (Advances in Chemical Research), Vol. 14, pp. 154 to 161 (1970).

These defined compounds have the advantage that they do not wet textile fibres, and that consequently their removal is particularly easy. Furthermore, they are immiscible not only with water but also with organic solvents, and can hence be employed also where the treatment medium consists of an organic solvent.

The use of these inert compounds poses no ecological problems; these compounds are not toxic, not poisonous and not combustible, and do not therefore constitute explosive mixtures. They are characterised by an extraordinarily high chemical and thermal stability, and with them there is a complete absence under the applied operating conditions in the process according to the invention of decomposition phenomena. Since they are not absorbed at all by the textile fibres, they have moreover no effect on the physical properties of the textile material, or on the fastness properties of the finishings. Similarly, the effect on handle is no greater than that in the case of treatments from aqueous liquor; and with wool there is also no extraction of fat from the substrate.

The amount of inert liquor is determined by the capacity of the treatment apparatus.

The process according to the invention is used for the pretreatment and finishing of organic materials, especially textile materials and leather, such as, e.g. for preliminary cleansing, desizing, bleaching, leaching, dyeing, optical brightening, antistatic finishing, mercerizing and soft-handle finishing. The materials can be in any processed form; i.e. textile materials can be, e.g. in the form of loose material, or of filaments, yarns, fabrics or knitwear.

Suitable textile materials are the most varied natural fibres, such as cellulose materials, e.g. cotton and regenerated cellulose materials, then wool and silk and synthetic materials such as polyamide, polyester and polyacrylonitrile materials.

The new process can however also be used for the finishing of mixed fabrics, e.g. those made from cotton and polyester or wool and polyester.

In the case of a dyeing-finishing process, the dyestuffs employed are those having affinity for the substrate; that is, e.g. for cellulose materials reactive dyestuffs and direct dyestuffs; for polyamide materials acid dyestuffs, which can contain fibrereactive groupings, or metal complex dyestuffs; for polyester materials disperse dyestuffs and disperse reactive dyestuffs; for polyacrylonitrile materials basic dyestuffs; and for leather leather dyestuffs. From the chemical point of view, these dyestuffs can belong to the most diverse classes, such as, e.g. nitroso dyestuffs, nitro dyestuffs, monoazo dyestuffs, disazo dyestuffs, trisazo dyestuffs, polyazo dyestuffs, stilbene dyestuffs, diphenylmethane dyestuffs, triarylmethane dyestuffs, xanthene dyestuffs, acridine dyestuffs, quinoline dyestuffs, methine dyestuffs, thiazole dyestuffs, indamine dyestuffs, indophenol dyestuffs, azine dyestuffs, oxazine dyestuffs, thiazine dyestuffs, sulphur dyestuffs, anthraquinone dyestuffs, indigoid dyestuffs and phthalocyanine dyestuffs.

In the case of an optical brightening process, suitable optical brighteners are, in particular, organic compounds containing at least 4 conjugated double bonds. Depending on the affinity for the substrate, anionic, cationic or disperse optical brighteners are used, which belong, from the chemical point of view, to the most varied classes, such as to the methine, azamethine, benzimidazole, coumarin, naphthalimide, pyrazoline, stilbene, benzocoumarin, pyrazine, oxazine or dibenzoxazolyl series.

The amounts in which the optical brighteners can be added to the bath can vary according to the degree of optical brightening desired; in general, amounts of about 1 to 10 g/l of liquor have proved satisfactory.

With regard to a bleaching process, this is performed, by a known method, oxidatively or reductively or by a combined oxidative-reductive method, depending on the substrate, i.e. there are added to the finishing liquor, e.g. chlorine products, oxygen products or reduction-bleaching products.

A similar operation is used where an antistatic finish is concerned, with antistatic agents as finishing agents being added to the finishing liquor. Suitable agents for the purpose are the well-known anion-active, cation-active and nonionic antistatic agents.

The new process is particularly advantageously performed in the case where the portion of the finishing liquor or pretreatment liquor containing the finishing agent consists of water, and the remaining volume, which is governed by the apparatus, made up by the inert organic compound as defined.

A particular procedure for carrying out the process is one whereby polyester materials are dyed from water in the ratio of 1:2, with the remaining volume in the dyeing apparatus being made up with perfluorinated tri-n-butylamine.

The invention relates further to the finishing and pretreatment liquor for carrying out the process, wherein the portion of the treatment liquor containing the processing agent constitutes the volumetrically smaller part, and the remaining portion of this liquor consists of at least one inert organic compound which is immiscible with the liquor containing the processing agent.

The processing agents to be used in the process according to the invention, such as dyestuffs, optical brighteners and finishing agents, are to be dissolved or dispersed in water and/or in the organic treatment medium.

It has been found that, surprisingly, it is not in any way necessary for an even application of the finishing or processing agent that the treatment medium be present as emulsion in the inert phase; a homogeneous dispersion suffices: e.g. one obtained by intensive circulation of the bath, and/or - depending on the type of machine - an adequate movement of the material. The process according to the invention can accordingly be carried out on all types of dyeing and finishing machines. These are, for example, all circulation machines in which the liquor can be kept in motion with the material remaining stationary, such as cheese dyeing machines, beam dyeing machines and jet machines; also machines in which the liquor and the material are in motion, such as, e.g. a bomb dyeing machine.

An addition of emulsifying agents is not necessary; on the other hand, all normal types of dyeing auxiliaries of surface-active character can be used if desired, such as, e.g. wetting agents, levelling agents, carriers or retarding agents. These optionally used agents must not form emulsions with the inert compound: they must therefore have no emulsifying action on the system, so that neither the finishing process nor the recovery of the inert compound is affected.

The used treatment liquors do not have to be distilled before re-use. The separation of the inert phase from the remaining constituents of the treatment bath is effected by decanting and, if necessary, by additional filtration through active charcoal, so that the inert phase may be used again for the next finishing process.

The process itself is performed in a manner whereby the processing agent is preferably dissolved in the treatment medium, to which is then optionally added a further solution of surface-active substances or dyeing or finishing agents, and the mixture is subsequently mixed with the defined inert organic compounds by vigorous shaking. The organic material is then introduced, the whole is again vigorously shaken briefly, and thereupon transferred, e.g. to a processing bomb and this is then placed into a bomb apparatus. With continuous mechanical movement, the temperature is raised, depending on the material to be finished, to about 70 to 140°C, and finishing is subsequently performed in the known manner.

There are obtained finished organic materials which have properties of fastness and levelness at least equal to those obtained by conventional processes, properties such as, in particular, fastness to light and to wet processing; and which give a degree of exhaustion of the finishing agent better than that in the case of conventional processes.

The following examples illustrate the invention without limiting its scope. The temperature values are expressed in degrees Centigrade, and parts are given as parts by volume.

The mentioned auxiliaries, such as wetting agents, levelling agents, carriers and retarding agents, have, by virtue of their chemical structure, no emulsifying action on the system.

EXAMPLE 1

0.1 g of the dyestuff of the formula

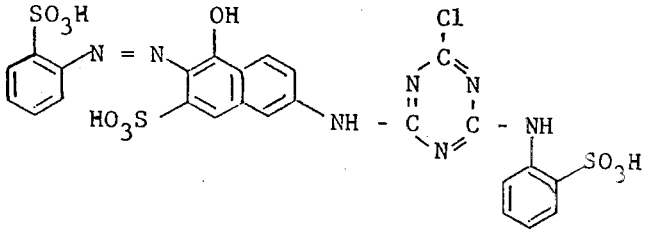

is dissolved in 3 ml of hot water. 0.02 g of 1-nitrobenzene-3-sulphonic acid (sodium salt), 0.5 g of anhydrous sodium carbonate and 0.025 ml of nonylphenolpolyglycol ether (ca. 10 moles of ethylene oxide) are dissolved in a further 7 ml of water. The two solutions are poured together and 90 ml of a perfluorinated cycloaliphatic ether ($C_8F_{16}O$) added. After the whole has been vigorously shaken, 5 g of a bleached and mercerized cotton fabric is introduced into the treatment bath. The whole is placed into a dyeing bomb which is heated in a special dyeing apparatus using bombs, with a continuous rotating movement, within 30 minutes from 30° to 90°. The treatment is continued for a further 30 minutes at this temperature. The material is subsequently rinsed cold and then hot, soaped at the boil and finally rinsed hot and cold.

There is obtained on the cotton fabric a strong, brilliant orange dyeing having good fastness to light and to wet processing.

If the dyestuffs listed in the following Table A, column II, as well as the inert organic compounds given in column III, are used, and the material shown in column IV is treated, with the procedure otherwise being analogous to that described in Example 1, then equally good results are obtained with the shades of colour contained in column V.

TABLE A
| I Ex. | II Dyestuff | III Inert organic compound | IV Material | V Shade |
|---|---|---|---|---|
| 2 | 0,15 g 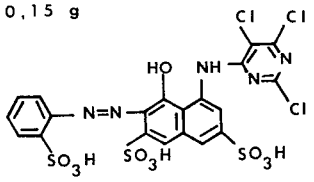 | perfluoro-decalin | mercerized cotton fabric | red |
| 3 | 0,15 g 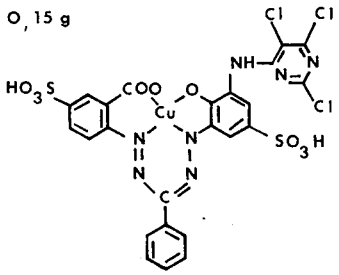 | perfluoro-dodecane | " | blue |
| 4 | 0,15 g 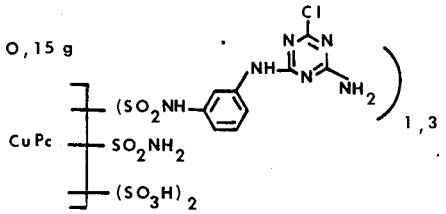 | perfluoro-octylethylene (B.P.:Kp 15 50–60°) | " | turquoise blue |
| 5 | 0,15 g x+y+z=4 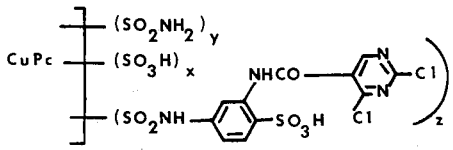 | perfluoro-octylpropy-lene (B.P.: Kp 12 60–70° | " | " |
EXAMPLE 6
0.1 g of the dyestuff of the formula
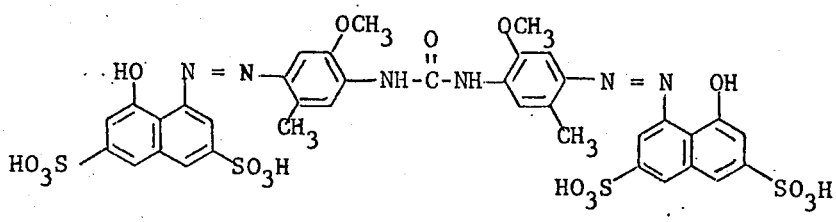

is dissolved in 5 ml of hot water. 0.05 g of nonylphenol-polyglycol ether (ca. 10 moles of ethylene oxide) is diluted with cold water and together with the dyestuff solution made up to a total of 10 ml. To this solution is added 40 ml of a perfluorinated cycloaliphatic ether ($C_8F_{16}O$), and the whole is thoroughly shaken and placed into a dyeing bomb. 5 g of cotton cretonne, bleached and leached, is introduced into the dyeing bath. The bomb is closed, well shaken and inserted into a special dyeing apparatus. The temperature is raised within 20 minutes to 95° and the treatment is performed for a further 20 minutes at this temperature, with the bomb rotating during the entire treatment. The dyeing is then rinsed in cold water. The rinsing process may also be performed with 20 ml of water and 30 ml of perfluorinated cycloaliphatic ether during several minutes in the apparatus.

There is obtained a deep red dyeing having fastness properties typical for this dyestuff.

If, in addition, 0.1 g of calcined Glauber's salt is added to the dye bath, with the procedure otherwise being as described, then an equally good result is obtained.

Example 7

0.005 g of the dyestuff of the formula

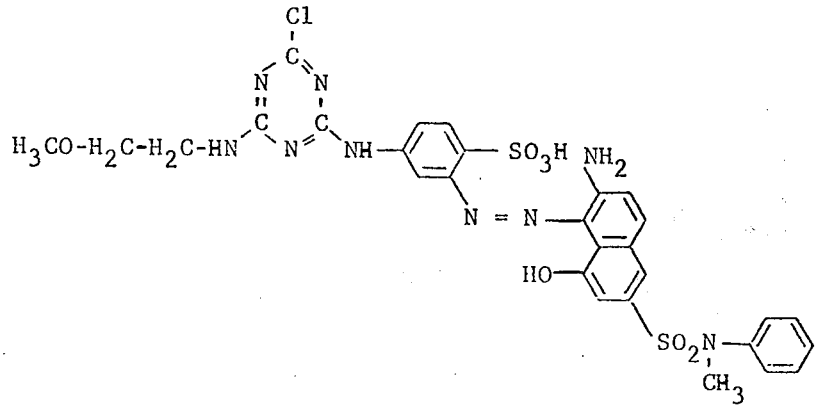

is dissolved in 3 ml of hot water. 0.1 g of a commercial anion-active levelling agent and 0.05 g of ammonium sulphate are likewise dissolved in warm water and together with the dyestuff solution made up to a volume of 10 ml. There is also added to this solution 40 ml of perfluorinated tri-n-butylamine $(C_4F_9)_3N$ to give a total liquor volume of 50 ml. This dye liquor is placed into a dyeing bomb and thoroughly mixed. 5 g of polyamide-6.6-Helanca tricot is introduced into this liquor; the bomb is closed, vigorously shaken and transferred to a special dyeing apparatus for bombs, wherein the said bomb is heated, with continuous rotation, within 20 minutes to 100°. The treatment is continued for a further 20 minutes at this temperature. Finally, the temperature is reduced to about 70°, and the material is rinsed in a fresh bath consisting of 10 ml of water and

EXAMPLE 8

0.0175 g of the dyestuff of the formula

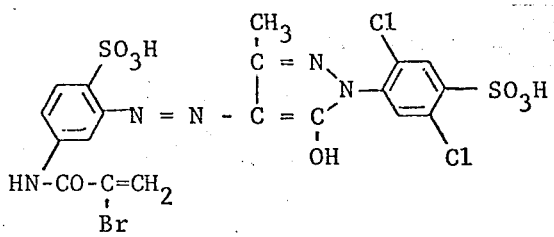

and 0.0125 g of the dyestuff of the formula

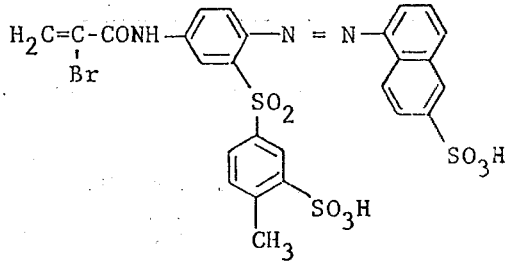

and 0.03 g of the dyestuff of the formula

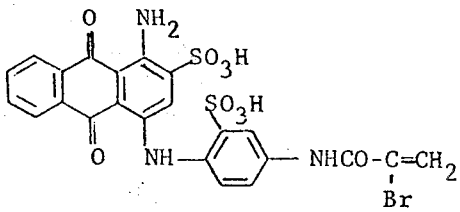

are dissolved together with 0.05 ml of acetic acid (80%) in 5 ml of hot water. 0.1 g of a mixture of dodecyldiphenylether disulphonate and N-oleylphenylethanolamine/polyglycol ether/methosulphate as well as 0.015 g of ammonium acetate are likewise dissolved in warm water, and together with the dyestuff solution made up to a volume of 10 ml. There is then also added 40 ml of perfluorooctane. The whole is 40 ml of perfluorinated tri-n-butylamine $(C_4F_9)_3N$ at 50° for 5 minutes. A level pink-red polyamide tricot having good fastness to light and to wet processing is obtained. placed into a dyeing bomb, mixed, and 5 g of polyamide-6.6-Helanca tricot is then introduced. The bomb is closed, thoroughly shaken and transferred to a special dyeing apparatus, wherein the temperature is raised, with continuous rotating movement, within 20 minutes to 100°. The treatment is continued for a further 40 minutes at this temperature. The apparatus is cooled finally to about 70°, and the material is subsequently rinsed in a bath containing 10 ml of water and 40 ml of perfluorooctane for 5 minutes at 50°.

There is obtained an evenly dyed grey polyamide tricot piece of medium depth of colour, which has good fastness to light and to wet processing.

If the dyestuffs, inert organic compounds and materials listed in the following Table B are used, with otherwise the same procedure, then equally good results are obtained.

TABLE B

| I Ex. | II Dyestuff | III Inert organic compound | IV Material | V shade |
|---|---|---|---|---|
| 9 | 0,125 g 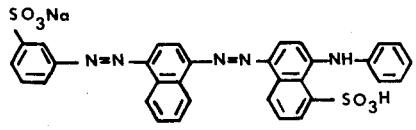 | perfluoro-alkane mixture B.P. 99–103° | polyamide-Helanca tricot | navy blue |
| 10 | 0,025 g 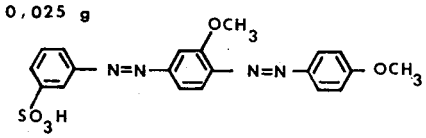 0,015 g 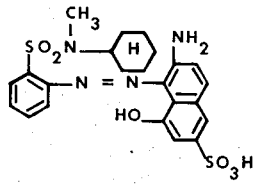 0,035 g 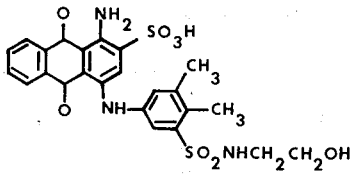 | perfluorinated tri-n-butylamine $(C_4F_9)_3N$ | " | grey |

EXAMPLE 11

0.1 g of the dyestuff of the formula

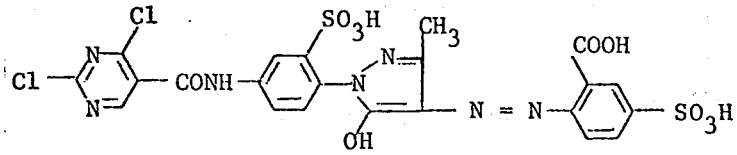

and 0.1 g of the dyestuff of the formula

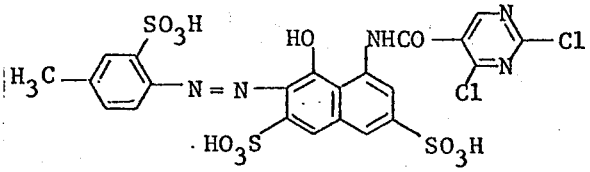

are dissolved in 10 ml of warm water at 50°. 0.15 ml of formic acid (85%) and 0.075 ml of nonylphenolpolyglycol ether (ca. 10 moles of ethylene oxide) are diluted in cold water, and together with the dyestuff solution made up to 15 ml. There is also added to this solution 85 ml of perfluoromethylcyclohexane to give a liquor volume of 100 ml. This treatment liquor is placed into a dyeing bomb and well mixed; 5 g of polyamide Helenca tricot is then introduced into the dye liquor. After vigorous shaking, the closed bomb is inserted into a special dyeing apparatus using bombs, wherein the bomb is heated, with continuous rotation, within 20 minutes from 30° to 80°. The treatment is continued for a further 20 minutes under these conditions and at this temperature. The apparatus is finally cooled to about 70°; the material is treated in a fresh bath containing 15 ml of water and 85 ml of perfluoromethylcyclohexane for 10 minutes at 80°, and then rinsed with cold water.

There is obtained an even scarlet-red polyamide dyeing with a very good dye yield.

If, instead of 0.15 ml of formic acid (85%), the same amount of acetic acid (80%) is used in the above example, the procedure otherwise being the same, then there is obtained an appreciably more bluish red shade having the same good fastness to light and to wet processing.

EXAMPLE 12

0.025 g of the dyestuff of the formula

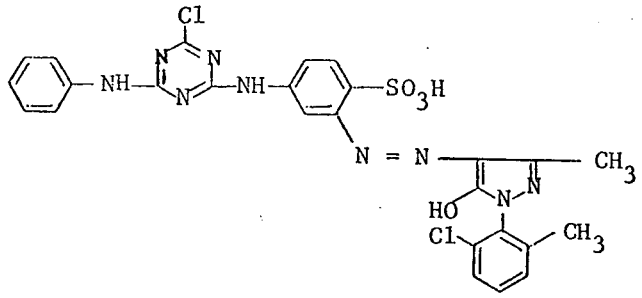

and 0.05 g of the dyestuff of the formula

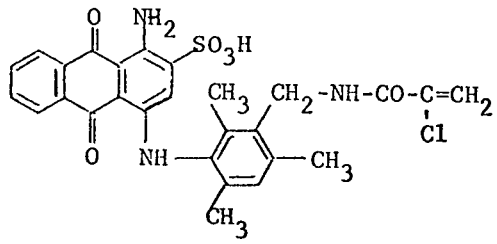

are dissolved in 5 ml of hot water. 0.05 g of ammonium sulphate, 0.05 g of the sodium salt of the condensation product of naphthalenesulphonic acid with formaldehyde and 0.025 ml of nonylphenolpolyglycol ether (ca. 10 moles of ethylene oxide) are likewise dissolved in 5 ml of water. The two solutions are poured together and 85 ml of perfluorinated tri-n-butylamine is added thereto. This treatment liquor is thoroughly shaken in a dyeing bomb and 5 g of wet wool flannel fabric (containing 5 ml of water) is introduced. The closed dyeing bomb is vigorously shaken and then inserted into a dyeing apparatus, wherein it is heated, with continuous rotation, within 40 minutes to 100°. The treatment is continued for a further 60 minutes under these conditions. The apparatus is finally cooled to about 70° and the materal is subsequently rinsed with warm water.

The rinsing process may also be performed with 20 ml of water and 80 ml of perfluorinated tri-n-butylamine, with a rotary motion, for 5 to 10 minutes at about 50°.

There is obtained a level green wool flannel dyeing of medium shade of colour, which has good fastness to wet processing and to light.

EXAMPLE 13

0.045 g of the dyestuff of the formula

1:2 Co-complex

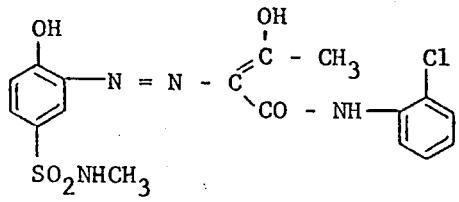

and 0.025 g of the dyestuff of the formula

Co-complex

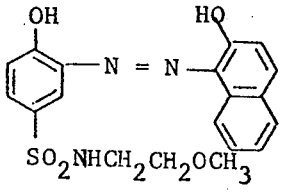

and 0.006 g of the dyestuff of the formula

1:2 Cr-complex

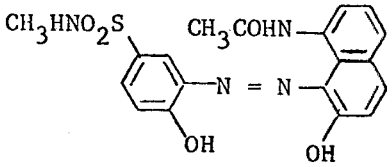

are dissolved together with 0.05 ml of 80% acetic acid in 5 ml of water. 0.025 g of stearyldiphenyloxethyldiethylenetriamine (ca. 100 moles of ethylene oxide) is diluted with cold water, and made up together with the dyestuff solution to 10 ml. A further addition is made thereto of 85 ml of perfluorinated tri-n-butylamine. This treatment liquor is mixed in a dyeing bomb and 5 g of wool flannel fabric (containing 5 ml of water) is introduced. The closed dyeing bomb is heated in an apparatus, with continuous rotation, within 40 minutes to 100°. The treatment is continued for a further 60 minutes under these conditions. The apparatus is finally cooled to about 70° and the material is subsequently rinsed with water.

The rinsing process may also be performed with 20 ml of water and 80 ml of perfluorinated tri-n-butylamine for about 5 to 10 minutes at 50°. The result is a level brown wool flannel dyeing of medium shade of colour, which had good fastness to wet processing and to light.

EXAMPLE 14

0.075 g of the dyestuff of the formula

1:1 Cr-complex

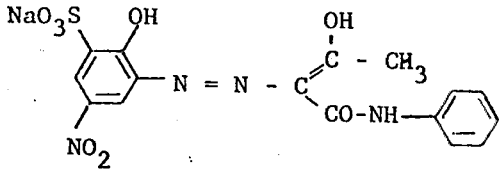

0.055 g of the dyestuff of the formula

1:1 Cr-complex

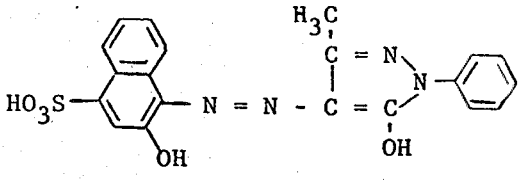

0.0175 g of the dyestuff of the formula

1:1 Cr-complex

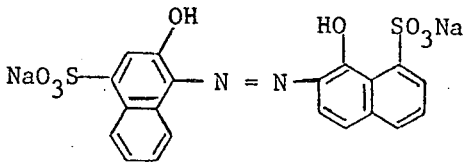

are dissolved together in 5 ml of hot water. 0.4 ml of sulphuric acid 66°Be and 0.05 g of a commercial amphoteric levelling agent based on ethylene oxide are likewise dissolved in 5 ml of water, and the two solutions are poured together. There is also added to this solution 85 ml of perfluorinated tri-n-butylamine and the whole is placed into a dyestuff bomb. 5 g of wet wool flannel fabric (containing 5 ml of water) is introduced into the treatment liqour. The closed bomb is heated in an apparataus, with continuous rotary motion, within 30 minutes to 100°. The treatment is performed for a further 90 minutes under these conditions. The apparatus is finally cooled to about 70° and the material is subsequently rinsed with warm water.

The result is a level brown wool dyeing of medium depth of colour, which has good fastness to wet processing and to light.

EXAMPLE 15

0.05 g of ammonium sulphate, 0.1 g of a commercial amphoteric levelling agent based on ethylene oxide and 0.05 ml of 80% acetic acid are dissolved in 5 ml of water. To this solution is added 85 ml of perfluorinated tri-n-butylamine. The whole is placed into a dyeing bomb and 5 g of wet wool flannel fabric (containing 5 ml of water) is introduced into the treatment bath. The closed bomb is treated in an apparatus, with a rotary movement, for 10 minutes at 50°. 0.045 g of the dyestuff of the formula

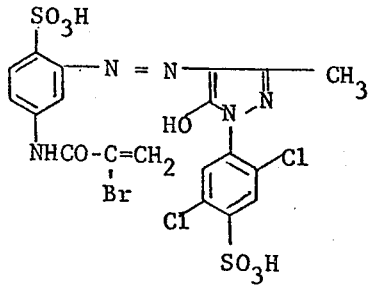

0.05 g of the dyestuff of the formula

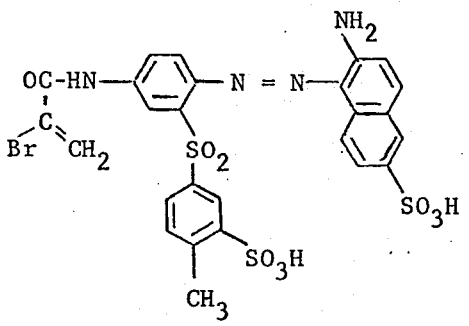

and 0.02 g of the dyestuff of the formula

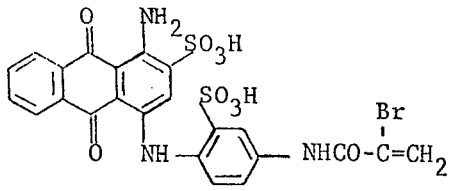

are dissolved in 5 ml of warm water. The pretreated material is removed from the bomb. The above dyestuff solution is placed into the treatment bath and thoroughly mixed. The wool substrate is then returned to the dyeing bomb, vigorously shaken and again put into the dyeing apparatus, wherein the bomb is heated, with a rotating movement, within 20 minutes from 50° to 75°. The treatment is performed for a further 20 minutes at this temperature; the temperature is then raised within 20 minutes to 100°, and dyeing is continued, with continuous rotation of the bomb, for 60 minutes at 100°. The apparatus is cooled in the course of 5 minutes to 80°. The bomb is taken from the apparatus and opened; the material is removed and the pH of the treatment bath is adjusted to about pH 8.5. The material is again placed into the dyeing bath and the bomb is closed and briefly shaken; the dyeing bomb is again transferred to the dyeing apparatus, and the treatment is continued, with continuous rotation, for 15 minutes at 80°. The material is finally rinsed with warm water, acidified with acetic acid and again rinsed with water.

There is obtained a level brown wool flannel dyeing having a high degree of fixing.

EXAMPLE 16

0.05 g of the dyestuff of the formula

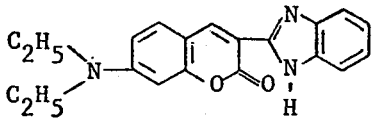

is dispersed in 5 ml of warm water at 50°. 0.2 g of ammonium sulphate, 0.1 g of the sodium salt of the condensation product of naphthalenesulphonic acid with formaldehyde and 0.05 ml of formic acid (85%) are dissolved likewise in 5 ml of water and then mixed with the dyestuff liquor. There is also added 40 ml of perfluorinated tri-n-butylamine and the whole is placed into a dyeing bomb and heated to 80°. After thorough mixing of the liquor, 5 g of polyester staple fabric is introduced into the dye liquor. The bomb is closed, vigorously shaken and transferred to a dyeing apparatus. The apparatus is heated within about 8 minutes to 120°, with the bomb continuously rotating, and the treatment is continued for 5 minutes at 120°. The temperature is then raised in the course of about 5 minutes to 140° and dyeing is performed for a further 30 minutes at this temperature. The apparatus is finally cooled within 10 minutes to about 80°; the dyeing is rinsed in a fresh water bath, then reductively scoured with sodium hydroxide solution and sodium hydrosulphite and stearyldiethylenetriamine at 85° and subsequently well rinsed. The rinsing and reductive scouring operation may also be performed with water, perfluorinated tri-n-butylamine and the appropriate additives.

There is obtained a very brilliant yellow polyester dyeing which, with regard to purity, depth of colour and fastness to sublimation, corresponds to those dyeings obtained by the conventional aqueous processes.

If, instead of the given dyestuff in the above example, one of the dyestuffs listed in the following Table C is used in the amounts shown there, with the procedure otherwise being as described in Example 16, then there is obtained on polyester fibre material likewise very deeply coloured and level dyeings in the shades given in the last column.

TABLE C

| Ex. No. | Dyestuff | Shade on polyester |
|---|---|---|
| | 0,1 g of mixture of | |
| 17 | 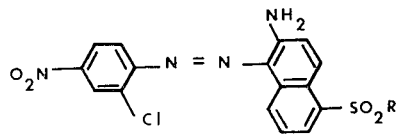 R = $NH_2$ = $NHCH_3$ | red |
| | 0,11 g of mixture of | |
| 18 | 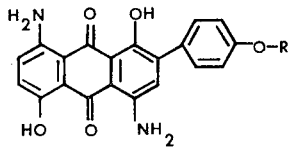 R = H (50%) = $CH_3$ (50%) | blue |
| | 0.05 g of | |
| 19 | 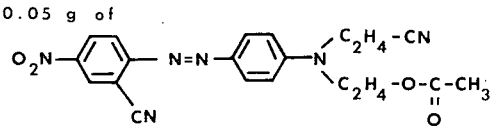 | navy blue |
| | 0.12 g | |
| 20 | 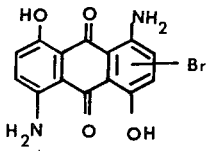 | blue |

EXAMPLE 21

0.1 g of dyestuff mixture of the formulae

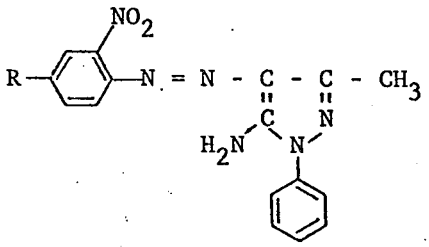

R = $C_2H_5SO_2$ = $CH_3SO_2$ 1:1 is dispersed in 10 ml of warm water at 50°, and to the dispersion are added 0.05 ml of 85% formic acid and 40 ml of perfluorinated tri-n-butylamine; the whole is placed into a dyeing bomb and this is then heated, in the closed condition, in a special dyeing apparatus to 80°. The dye liquor is to be thoroughly mixed before the introduction of 5 g of polyester staple fabric. The bomb is again closed and placed back into the apparatus, whereupon this is heated, with continuous rotation, within 20 minutes to 120° to 122°. The treatment is performed at this temperature for a further 30 minutes and the apparatus is then cooled to about 80°. The staple fabric is rinsed with water, in the usual manner reductively scoured and rinsed, and dried in a stream of warm air.

The rinsing and reductive scouring operations may also be performed with water/fluorinated chemical, e.g. 10 to 20 ml of water and 40 to 30 ml of perfluorinated tri-n-butylamine, under analogous conditions.

There is obtained a deeply coloured gold-yellow polyester dyeing having the, for this dyestuff, usual good fastness to light and wet processing.

EXAMPLE 22

0.1 g of a dyestuff mixture of the formulae

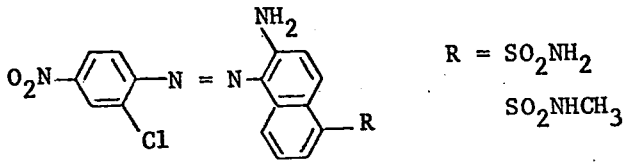

$R = SO_2NH_2$ / $SO_2NHCH_3$ 1:2 is dispersed in 9 ml of warm water; 1 ml of benzyl alcohol and 0.05 ml of 85% formic acid are added, and the whole is made up with perfluorinated cycloaliphatic ether of the formula $C_8F_{16}O$ to a total volume of 100 ml. This dye liquor is heated in a closed dyeing bomb to 50°, and 5 g of polyester staple fabric is then introduced into the bomb. The temperature is raised within 20 minutes to 100°, with the dye bomb continuously rotating. The treatment is continued for 30 minutes at this temperature, and the apparatus is subsequently cooled in about 5 minutes to 70°. The dyeing is rinsed and washed in the usual manner. A very deeply coloured red polyester dyeing is obtained.

If, in the above example, the perfluorinated cycloaliphatic ether of the formula $C_8F_{16}O$ is replaced by identical amounts of the inert compounds given in the following table, with otherwise the same procedure, then there is likewise obtained a deeply coloured red polyester dyeing.

TABLE D

| Example No. | Inert compound |
|---|---|
| 23 | perfluorokerosene (Pierce Chemical Company) |
| 24 | perfluoro-(1-methyldecalin) (Pierce Chemical Company) |
| 25 | perfluorinated cycloaliphatic ether of the formula $F-(CF(CF_3)-CF_2-O)_4-CF_2-CF_3$ (boiling point 194°) |

EXAMPLE 26

0.035 g of the dyestuff mixture given in Example 21 is dissolved in 10 ml of warm isopropyl alcohol, and the solution is made up with 40 ml of perfluorinated tri-n-butylamine to a total volume of 50 ml. This dye bath is heated in a closed bomb to 80°. 5 g of polyester staple fabric (pretreated ready for dyeing) is introduced into the thus prepared bath and well shaken; the closed bomb is then placed into a special dyeing apparatus; the temperature is raised within 25 minutes to 140°, with the dye bomb continuously rotating. The treatment is continued for 30 minutes at this temperature; the apparatus is cooled in the course of 5 to 10 minutes to about 90°, and the material is subsequently rinsed twice with 50 ml of isopropyl alcohol each time for 5 minutes at 85°.

There is obtained a deeply coloured gold-yellow polyester dyeing, which, for the purpose of obtaining optimum fastness to light, is subsequently treated, after drying, for about 5 minutes in saturated steam at ca. 102 to 105°.

EXAMPLE 27

0.1 g of the dyestuff of the formula

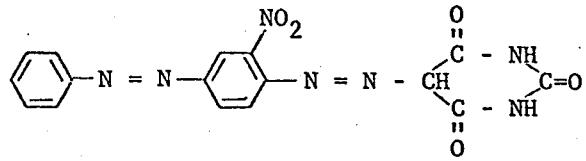

is dispersed in 7 ml of warm ethylene glycol monoethyl ether, and the dispersion is made up by the addition of 43 ml of perfluorinated tri-n-butylamine to a volume of 50 ml. This dye liquor is heated in a closed dye bomb, in a special dyeing apparatus, to 80°. 5 g of polyester staple fabric is now introduced into the treatment liquor, thoroughly shaken and then heated in the apparatus, with continuous rotation, within 20 minutes to 122°. The treatment is continued for 30 minutes at this temperature, and the apparatus is subsequently cooled within about 5 minutes to 90°. The finishing of the dyeing is performed as described in Example 26. A deeply coloured yellow polyester dyeing is obtained.

If, instead of 0.1 g of the dyestuff of the above constitution, the dyestuffs given in the following Table E are used in the stated amounts, and, instead of polyester staple fabric, the following materials are treated, the procedure otherwise being the same, then equally good results are obtained.

TABLE E

| Ex. No. | Dyestuff / amount | Shade on |
|---|---|---|
| 28 | 0.275 g of a dyestuff mixture of the formulae 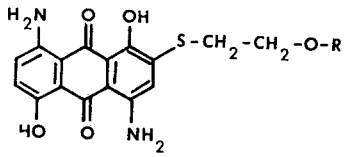 with R = H (ca. 70%) $-CH_2-CH_2-S-CH_2-CH_2-OH$ (ca. 30%) | polyester-staple fabric blue |
| 29 | 0.05 g of 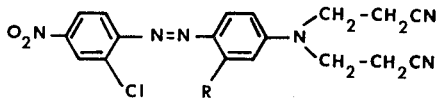 R = H (50%) = $-CH_3$ (50%) | polyester-crimplene tricot orange |
| 30 | 0.05 g of 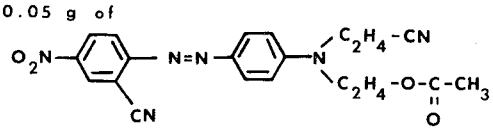 | polyester-crimplene tricot red |

EXAMPLE 31

0.2 g of ammonium sulphate, 0.05 g of dinaphthylmethane. disulphonate, 0.5 g of o-phenylphenol and 0.05 ml of 85% formic acid are dissolved in 7 ml of water. To this solution is then added 85 ml of perfluorinated tri-n-butylamine and the whole is placed into a dyeing bomb and well shaken. 5 g of a mixed fabric made from wool/Trevira, which has previously been wetted in warm water, containing 5 ml of water is subsequently introduced into the treatment bath and treated for 10 minutes at 60° in an apparatus, wherein the dyeing bomb is constantly rotating.

0.1 g of a dyestuff mixture of the formulae

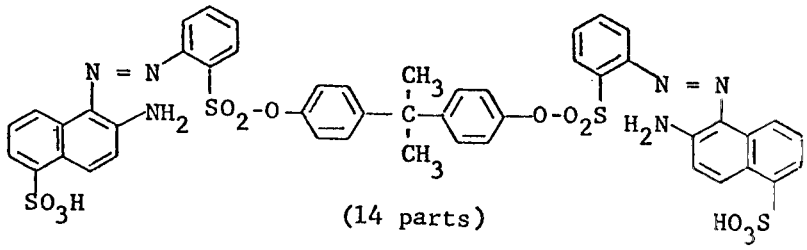

(14 parts)

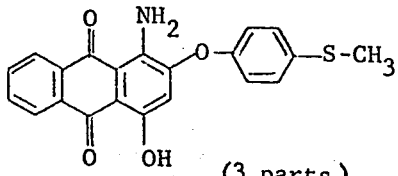

(3 parts)

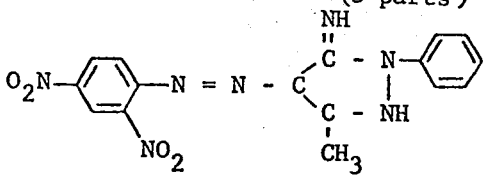

(20 parts)

and 63 parts of Glauber's salt are together dissolved in 3 ml of warm water. This dyestuff solution is then added to the treatment liquor and thoroughly shaken. The closed bomb is returned to the dyeing apparatus. The temperature is raised within 40 minutes to 100° and dyeing is continued at this temperature for 90 minutes, during which time the bomb is continuously rotating. The apparatus is subsequently cooled to about 70°, and the material is rinsed firstly hot and then at 40° with water. There is thus obtained a tone-in-tone-dyed wool/Trevira mixed fabric having a strong orange dyeing. The dyeing displays a good levelness.

EXAMPLE 32

0.075 g of the dyestuff of the formula

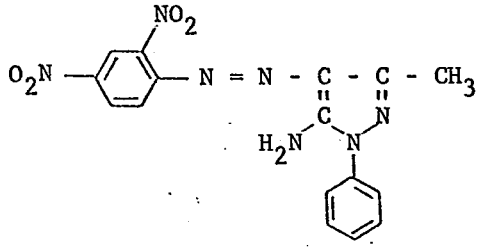

is dispersed in 5 ml of warm water at 50°.

0.1 g of the dyestuff of the formula

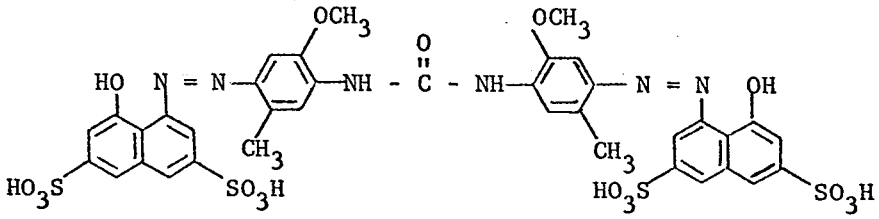

is dissolved in 4 ml of hot water.

These two solutions are poured together and 1 ml of benzyl alcohol is added. The whole is now made up with 90 ml of a perfluorinated cycloaliphatic ether of the formula $C_8F_{16}O$ to a total volume of 100 ml; this is transferred to a dyeing bomb and vigorously shaken. 5 g of a washed-out mixed fabric made from cotton/terylene (mixture ratio 62/38) is introduced into the dye bath. The bomb is closed, thoroughly shaken and placed into a special apparatus, wherein the temperature is raised within 20 minutes from 60° to 100°, with the bomb continuously rotating. Dyeing is performed for a further 40 minutes at 100°, and the apparatus is then cooled to about 80°. The dyeing is rinsed with cold water and with warm water. There is obtained as the overall impression a copper-red cotton/terylene dyeing, wherein the terylene fibre is dyed a brilliant orange and the cotton in a bluish deep red shade. The shades of colour on the two fibres correspond to those of the separately dyed fibres.

EXAMPLE 33

0.05 g of the dyestuff of the formula

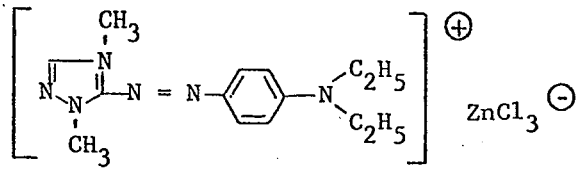

is dissolved together with 0.1 ml of 80% acetic acid in 6 ml of hot water. 0.1 g of a condensation product from naphthalene-2-sulphonic acid and formaldehyde and 0.05 g of stearyldiethylenetriamine having 17.5 moles of ethylene oxide are each dissolved in 2 ml of water. These three solutions are poured together and 40 ml of a perfluorinated cycloaliphatic ether of the formula $C_8F_{16}O$ is added. The whole is placed into a dyeing bomb and heated to 60°. 5 g of Orlon staple yarn, high-bulk, type 42, is introduced into the dye liquor; the whole is vigorously shaken and the closed bomb is then placed into a special dyeing apparatus for bombs. The temperature is raised within 30 minutes to 100°, with the bomb constantly rotating. Dyeing is performed for a further 30 minutes under these conditions; the apparatus is cooled within 10 minutes to ca. 60°, and the material is then rinsed with water. The yarn is finally dried in a stream of warm air.

There is thus obtained on orlon yarn a level, medium, pure red shade having the usual fastness to light and to wet processing.

Advantageously, the dyed and dried material is finally treated for about 5 minutes under saturated-steam conditions at about 102°, whereupon a good fastness to light of the resulting dyeing is ensured.

EXAMPLE 34

If, instead of the dyestuff given in Example 33, 0.05 g of the dyestuff of the formula

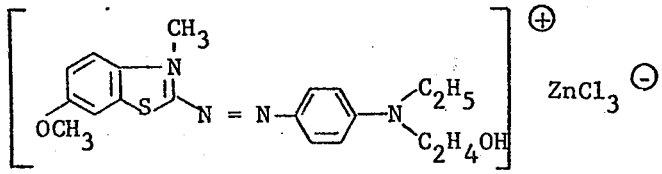

is used, with the procedure otherwise remaining the same, then there is obtained on orlon yarn a level blue dyeing having good fastness to light and to wet processing.

EXAMPLE 35

0.4 g of the iron complex of the formula

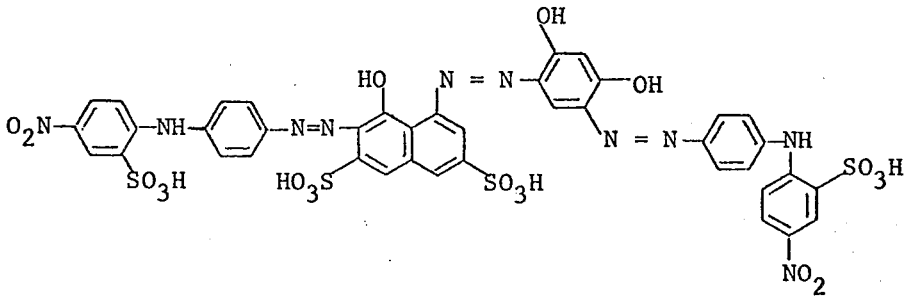

is dissolved in 10 ml of warm water. 0.1 g of 25% ammonia is diluted in 5 ml of water and added to the aforementioned dyestuff solution. A total volume of 50 ml is obtained by addition of perfluorinated tri-n-butylamine.

This dye liquor is heated in a closed dyeing bomb to 50°. In this liquor there is then dyed 5 g of chrome-skiver-velvet leather, prepared ready for dyeing, for one hour at 50° in the rotating closed bomb. 0.3 ml of 85% formic acid is then added to the dye liquor and dyeing is performed for a further 30 minutes at 50°. The material is subsequently rinsed with cold water and dried in air.

There is obtained a dark brown skiver-velvet leather well dyed throughout, the handle properties of which are completely identical to those of a comparative sample not dyed.

EXAMPLE 36

0.15 g of the dyestuff of the formula

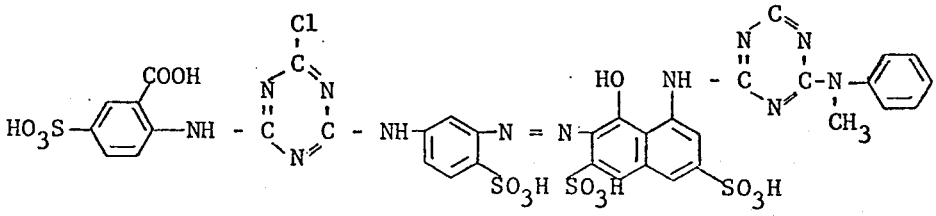

is dissolved in 9 ml of hot water. 0.05 g of 1-nitrobenzene-3-sulphonic acid (sodium salt) is dissolved in 1 ml of warm water and mixed with the dyestuff solution. An addition is then made of 38 ml of a perfluorinated cycloaliphatic ether of the formula $C_8F_{16}O$. The whole is placed into a dyeing bomb and thoroughly shaken. 5 g of a mixed fabric made from polyester/cotton (mixture ratio 50:50) is introduced into the dye liquor. The bomb is closed, well shaken and then treated, with continuous rotation, in a special dyeing apparatus for 15 minutes at 85°. There is subsequently made an addition of 0.3 g of calcined sodium carbonate. A further addition of 0.3 g of calcined sodium carbonate is made after 10 minutes. The material being dyed is removed after 10 minutes from the bomb, and the liquor is neutralised by the addition of 0.05 ml of 85% formic acid and 0.1 g of ammonium sulphate. Finally, 0.05 g of the dyestuff of the formula

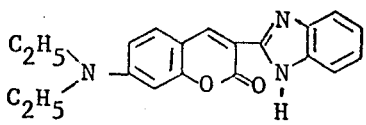

is dispersed together with 0.015 ml of a condensation product from 1 mole of the sodium salt of 2-laurylbenzimidazole-sulphonic acid and 9 moles of ethylene oxide in 2 ml of warm water, and 1.2 ml of benzyl alcohol is added.

The treatment liquor is well mixed, the material being dyed is returned to the bomb, thoroughly shaken, and again dyed in the apparatus, with continuous rotation. The dye bath is heated within about 10 minutes to 100°; dyeing is performed for a further 30 minutes at this temperature, and the temperature is then lowered in the course of about 10 minutes to 80°. The dyed substrate is finally rinsed in water as usual and soaped in boiling solution.

There is obtained a polyester/cotton mixed fabric dyed in two colours, the polyester part being dyed in a brilliant yellow shade and the cotton part in a brilliant red shade.

EXAMPLE 37

0.05 g of the dyestuff of the formula

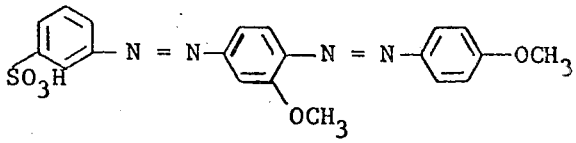

is dissolved in 5 ml of methanol. 0.0375 ml of 80% acetic acid, 0.05 g of ammonium acetate and 0.05 g of a commercial anion-active levelling agent are dissolved likewise in 5 ml of methanol. The two solutions are poured together and the total volume is made up with 90 ml of perfluorinated tri-n-butylamine. The whole is placed into a dyeing bomb and mixed; 5 g of polyamide-6.6-Helanca tricot is then introduced. The bomb is closed, thoroughly shaken and afterwards inserted into a special dyeing apparatus, wherein, with a continuous rotary movement of the bomb, the temperature is raised within 20 minutes to 100°. The treatment is continued for 30 minutes at this temperature. Finally, the temperature is lowered to about 70° and the material is subsequently rinsed for 5 minutes at 50° in a bath containing 10 ml of methanol and 90 ml of perfluorinated tri-n-butylamine.

There is thus obtained a level intense yellow dyeing having the fastness properties usual for this dyestuff.

EXAMPLE 38

0.05 g of the dyestuff of the formula

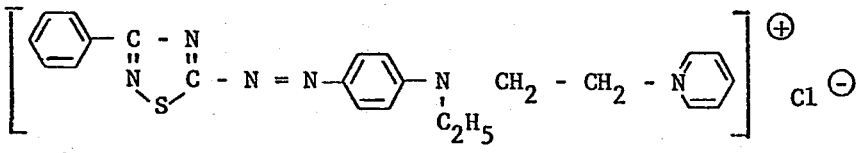

is dissolved together with 0.1 ml of 80% acetic acid in 6 ml of methanol. 0.1 g of a condensation product from naphthalene-2-sulphonic acid and formaldehyde and 0.05 g of stearyldiethylenetriamine having 17.5 moles of ethylene oxide are each dissolved in 2 ml of methanol. These three solutions are poured together and 90 ml of perfluorinated tri-n-butylamine is added. The whole is placed into a dyeing bomb and heated to 60°. 5 g of Orlon staple yarn, high-bulk, type 42, is introduced into the dye liquor and this vigorously shaken; the closed bomb is then put into a special dyeing apparatus for bombs. The temperature is raised to 100° within 30 minutes, with the bomb continuously rotating. Dyeing is performed for a further 30 minutes at this temperature, and the apparatus is subsequently cooled within 10 minutes to 60°. Finally, rinsing is carried out in a fresh bath, containing 10 ml of methanol and 90 ml of perfluorinated tri-n-butylamine, for 5 minutes at 60°. The yarn is dried in a stream of warm air. There is obtained an intense red dyeing having good fastness properties.

EXAMPLE 39

0.015 g of the optical brightener of the formula

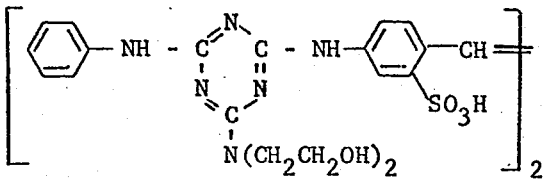

is dissolved in 5 ml of warm water at 30°. 0.05 g of disodium phosphate is likewise dissolved in warm water at 30°, and together with the brightener solution is made up to 10 ml. A total bath volume of 100 ml is obtained by the addition of 90 ml of a perfluorinated cycloaliphatic ether of the formula $C_8F_{16}O$. 5 g of prebleached and mercerised cotton poplin fabric is introduced into the treatment bath, which has been previously well stirred. The whole is placed into a closed dyeing bomb and vigorously shaken. This dyeing bomb is now transferred to a special dyeing apparatus for bombs, wherein the bomb, with continuous rotary movement, is heated in a water bath within 20 minutes to 85° to 87°. The treatment is continued for 20 minutes at this temperature. The temperature is then lowered in the course of 5 minutes to about 70°; the textile material is removed from the bomb and the treatment liquor is squeezed out to the maximum possible extent. Finally, rinsing is performed with 10 ml of water and 90 ml of a perfluorinated cycloaliphatic ether of the formula $C_8F_{16}O$ for several minutes at 40° in the rotating bomb. The fabric is squeezed out and dried in a stream of warm air.

The result is a level, very well optically brightened cotton fabric having a fastness to light and to wet processing usual for this brightener.

EXAMPLE 40

If, instead of the 90 ml of perfluorinated cycloaliphatic ether given in Example 39, the same amount of perfluorinated tri-n-butylamine is used, and 0.025 ml of nonylphenolpolyglycol ether having ca. 10.5 moles of ethylene oxide is added, with the procedure being otherwise as described, then a very well optically brightened cotton poplin fabric is obtained.

EXAMPLE 41

0.03 g of the optical brightener of the formula

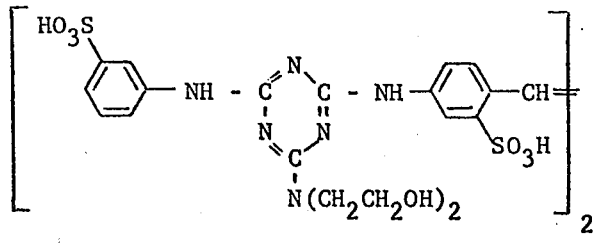

is dissolved in 5 ml of warm water at 30°. 0.025 g each of disodium phosphate and monosodium phosphate is likewise dissolved in warm water at 30°, and made up together with the brightener solution to 10 ml. This is made up to a total volume of 100 ml by the addition of 90 ml of perfluorinated cycloaliphatic ether of the formula $C_8F_{16}O$. With the procedure otherwise as given in Example 39, there is likewise obtained a very well brightened cotton poplin fabric having the same good fastness to light and to wet processing as in the case of the conventional aqueous treatment.

EXAMPLE 42

If, instead of the optical brightener given in Example 39, 0.02 g of the optical brightener of the formula

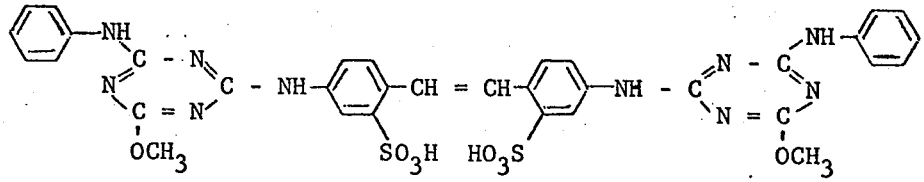

is used, and 0.05 g of disodium phosphate is added to the bath, the procedure being otherwise as described in Example 39, then there is obtained on cotton poplin fabric likewise an excellently brightened white having a fastness to light and wet processing identical to that of a conventionally treated substrate.

EXAMPLE 43

0.125 g of the optical brightener of the formula

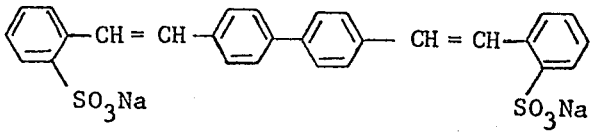

is diluted with 5 ml of warm water at 30°. 0.025 g each of disodium phosphate and monosodium phosphate is likewise dissolved in warm water at 30°, and together with the brightener solution made up to 10 ml. This is now made up with 90 ml of a perfluorinated cycloaliphatic ether of the formula $C_8F_{16}O$ to a total volume of 100 ml.

If the cotton fabric used in Example 39 is replaced by 5 g of washed-out, pre-fixed polyamide-6 woven tricot, with the procedure otherwise being the same as that described in Example 39, then there is obtained a very well optically brightened polyamide woven tricot having a fastness to light and to wet processing practically identical to that resulting from corresponding aqueous treatments.

EXAMPLE 44

0.1 g of the optical brightener of the formula

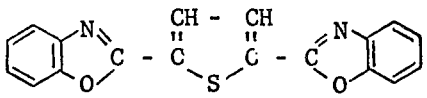

is dissolved in 5 ml of warm water at 40°. 0.025 g of disodium phosphate and 0.02 g of a condensation product from 1 mole of stearyl alcohol and 35 moles of ethylene oxide is likewise dissolved in warm water at 40°, and made up together with the brightener solution to 10 ml. A total volume of 100 ml is then obtained by addition of 90 ml of perfluorinated cycloaliphatic ether of the formula $C_8F_{16}O$. 5 g of washed Dacron staple fabric, type 54, is introduced into the treatment bath, which has previously been well stirred. The whole is transferred to a pressure-tight closed dyeing bomb and well shaken. This dyeing bomb is now put into a special dyeing apparatus for bombs, wherein the bomb, with a continuous rotary movement, is heated in a water bath (autoclave) within 20 minutes to 100°. The treatment is performed for a further 30 minutes at this temperature. Finally, the apparatus is cooled to about 80°, and the material is rinsed with warm water and dried in the usual manner. The rinsing process may also be carried out with 10 ml of water and 90 ml of perfluorinated cycloaliphatic ether of the formula $C_8F_{16}O$ for several minutes at about 50° with vigorous shaking.

The result is a very well optically brightened Dacron fabric which in the degree of whiteness is equal to that obtained from the aqueous application. The fastness to light and to wet processing is likewise good.

Comparative tests performed from water/perchloroethylene systems (under chemical or mechanical emulsifying conditions) by no means produce the high degree of brightening obtained in the present example.

If, instead of the given 90 ml of perfluorinated cycloaliphatic ether of the formula $C_8F_{16}O$, the same amount of perfluorinated tri-n-butylamine is used and 0.2 g of a condensation product from 1 mole of stearyl alcohol and 35 moles of ethylene oxide is added, the procedure otherwise being as described, then there is obtained a well optically brightened Dacron fabric having good fastness to light and to wet processing.

EXAMPLE 45

0.1 g of the optical brightener of the formula given in Example 44 and 0.025 g of the optical brightener of the formula given in Example 41 are dissolved in 5 ml of warm water at 40°. 0.025 g of disodium phosphate is likewise dissolved in warm water at 40°, and together with the brightener solution made up to 10 ml. A total volume of 100 ml is then obtained by addition of 90 ml of perfluorinated cycloaliphatic ether of the formula $C_8F_{16}O$.

If now 5 g of a washed and pre-bleached mixed fabric made from cotton/Diolen is treated, the procedure being otherwise as described in Example 44, then there is obtained a well brightened cotton/Diolen mixed fabric having good fastness to light and to wet processing.

EXAMPLE 46

0.1 g of the optical brightener of the formula

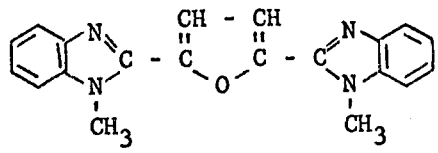

is dissolved in 5 ml of warm water at 40°. 0.2 ml of oxalic acid is dissolved in warm water at 40°, and together with the brightener solution is made up to 10 ml. A total volume of 100 ml is then obtained with 90 ml of perfluorinated cycloaliphatic ether of the formula $C_8F_{16}O$.

If 5 g of a washed Orlon staple fabric, type 75, is now treated, with the procedure otherwise being as given in Example 44, then there is obtained a very well brightened Orlon fabric having good fastness to light and to wet processing.

EXAMPLE 47

0.04 g of the optical brightener of the formula

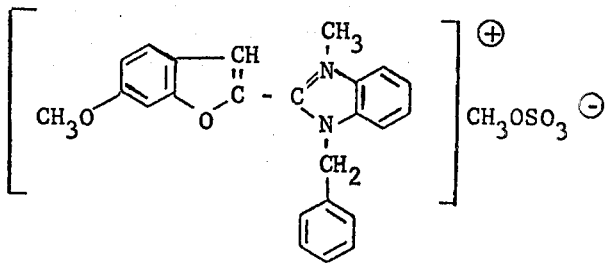

is dissolved in 10 ml of warm water at 30°, and the solution is adjusted with formic acid to a pH-value of 4.5. A volume of 100 ml is then obtained by the addition of 90 ml of perfluorinated cycloaliphatic ether of the formula $C_8F_{16}O$. 5 g of washed Courtelle staple fabric is introduced into the treatment bath and well shaken. The whole is placed into a pressure-tight dyeing bomb and again vigorously shaken. This dyeing bomb is then transferred to a special dyeing apparatus for bombs, wherein the bomb, continuously rotating, is heated in a water bath within 15 minutes to 88° to 90°. The treatment is continued for 30 minutes at this temperature. Finally, the apparatus is cooled to about 60°, and the material is subsequently rinsed with warm water and then dried as usual.

There is obtained a very well brightened Courtelle staple fabric having very good fastness to light.

Comparative brightening tests performed from water/perchloroethylene treatment liquors produced by no means the same high degree of whiteness.

EXAMPLE 48

0.2 g of the optical brightener of the formula given in Example 43 is dissolved in 2 ml of water. 0.025 g each of di- and monosodium phosphate is dissolved in 2 ml of water in each case. 0.18 g of sodium dithionite and 0.12 g of tetrasodium pyrophosphate are likewise dissolved in 2 ml of water. These 3 solutions are poured together, and 90 ml of perfluorinated cycloaliphatic ether of the formula $C_8F_{16}O$ is added.

5 g of wool fabric (which has been preliminarily bleached with $H_2O_2$ and subsequently squeezed out to 80% water content) containing 4 ml of water is introduced into the thoroughly stirred treatment bath and well shaken. The whole is placed into a dyeing bomb and treated in a dyeing apparatus for bombs, with a continuous rotary movement. The temperature is raised within 15 minutes to 60°, and the treatment is continued for 35 minutes at this temperature. Finally, the material is rinsed with warm water at about 40°.

The result is a well optically brightened wool fabric having good fastness to light and to wet processing.

EXAMPLE 49

0.2 g of sodium hypochlorite, 0.05 ml of NaOH 36°Be and 0.1 ml of a mixture consisting of 1 part by weight of a condensation product from 8 moles of ethylene oxide and 1 mole of p-tert.octylphenol and 3 parts by weight of water are dissolved in 15 ml of cold water. To this solution is added 85 ml of perfluorinated tri-n-butylamine. The finished bleaching liquor is put into a bomb, and 5.0 g of cotton fabric is placed unbleached into the bath. The closed bomb is then treated in a special apparatus, with continuous rotation, for 90 minutes at 25°. The material is afterwards rinsed with cold water and subsequently treated for 15 minutes at 45°, again in a closed bomb with continuous rotation, in a fresh bath containing 0.2 g of sodium bisulphite, 0.1 ml of formic acid (85%) dissolved in 15 ml of water, and 85 ml of perfluorinated tri-n-butylamine. The material is finally rinsed with cold water.

There is obtained a well bleached cotton fabric which is equally as good, with regard to bleaching effect, as that produced in a conventionally performed test in an aqueous liquor (ratio of goods to liquor 1:40) wherein there is used double the amount of chemicals.

EXAMPLE 50

The polyamide-6.6 Helanca tricot dyed in Example 8 is given, after the rinsing process and before drying, an antistatic finish as follows.

The rinsed substrate is pressed out, and treated for about 15 minutes in a bath prepared in the following manner: 0.015 g of a commercial amphoteric softening agent based on fatty acid/polyamide is dispersed in 5 ml of hot water, and with 5 ml of cold water as well as 40 ml of perfluorinated tri-n-butylamine the temperature is adjusted to about 45°.

The dyed material is treated in the treatment liquor in a closed dyeing bomb, with continuous rotation, for about 15 minutes at 45°. The material is then pressed out and afterwards dried in a stream of warm air.

A material having an antistatic finish is obtained.

EXAMPLE 51

0.075 g of a commercial cation-active soft-handle agent is dissolved in 5 ml of water; a further 5 ml of water and 40 ml of perfluorodecalin are added, with the temperature being adjusted to 40°. 5 g of mercerised and bleached cotton yarn is kept for 30 minutes in the described mixture in a closed dyeing bomb with continuous rotation. The material is afterwards squeezed out, and then dried in a stream of warm air.

Compared with an untreated sample, the treated material has acquired a soft compact handle.

EXAMPLE 52

For the purpose of mercerising, dressed grey cotton fabric is immersed on a stretching frame at room temperature in a solution consisting of 10 ml of NaOH 20°Be, 40 ml of perfluorinated tri-n-butylamine and 0.1 ml of a commercial wetting agent based on sulphuric acid ester, with case being taken that the solution remains thoroughly mixed during the period of immersion.

After the fabric has been removed and squeezed out, it is firstly rinsed warm and, after acidification with acetic acid and subsequent rinsing, dried.

The treated fabric possesses a good handle, sheen and, in comparison with an untreated sample, an improved dyestuff absorption in the subsequent dyeing process.

EXAMPLE 53

13 g of the dyestuff mixture of the formulae

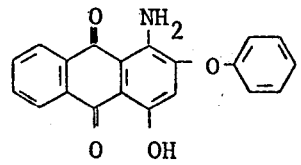

and

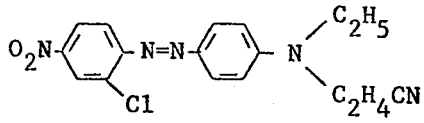

is dispersed in 2100 ml of water at 80°, and the pH-value of the dispersion is adjusted to 5 with 80% acetic acid.

A laboratory circulation apparatus for 1 spool (type Obermaier) is charged with 650 g of polyester staple yarn. The above described dyestuff solution and 8400 ml of perfluorodecalin are thoroughly mixed in the preparing vessel by means of a stirrer, and the liquor is quickly drawn into the apparatus. The liquor is allowed to circulate in a closed circulation from the inside to the outside, with the liquor temperature being raised within 30 minutes from 20° to 130° and maintained at 130° for a further 30 minutes whilst the liquor continuously circulates. The liquor is subsequently cooled to 70°, and the completely exhausted dye bath is drawn off; the whole of it is collected and processed for re-use. A rinsing bath is prepared from 2100 ml of water at 80°, 3 g of nonylphenolpolyglycol ether and 8400 ml of perfluorodecalin, and is then drawn into the apparatus as above in the case of dyeing. Rinsing is performed for 10 minutes at 80°, and the bath is then drained off and collected. The dyeing is subsequently given a finishing treatment: there is obtained by this process an even red-dyed PES spool having very good fastness properties.

EXAMPLE 54

6.5 g of the dyestuff of the formula

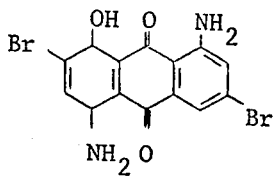

is dissolved in 2100 ml of perchloroethylene. The procedure then followed is as described in Example 53 except that the dyeing temperature is held at 121° instead of at 130°, and the rinsing bath is prepared with perchloroethylene and not with water as in Example 53. The details otherwise of the procedure carried out are as given in Example 53. After finishing, there is obtained evenly dyed blue polyester yarn having very good fastness properties.

We claim:

1. A process for the treatment of materials with processing agents dissolved or dispersed in water or in organic solvents, wherein the material is contacted with said processing agents in a material to liquor ratio of from 1:0.5 to 1:5 with a treatment liquor consisting of two fluid portions wherein that portion containing the processing agents constitutes the volumetrically smaller part, and the remaining portion of this treatment liquor consists of at least one aliphatic, cycloaliphatic or aromatic inert organic compound, which is perfluorinated or mixed halogenated or which contains a perfluorinated or mixed halogenated radical, said inert organic compound being immiscible with the portion containing the processing agent and said portion containing the processing agent optionally also containing additional auxiliaries that do not form an emulsion with said inert organic compound, the system being very thoroughly mixed during the treatment process.

2. Process according to Claim 1, wherein the portion of the liquor containing the processing agent is water.

3. Process according to Claim 1, wherein the portion of the finishing liquor containing the processing agent is methanol, isopropyl alcohol, benzyl alcohol, ethylene glycol monoethyl ether, or perchloroethylene.

4. Process according to Claim 1, wherein the inert organic compounds used are perfluorinated organic compounds.

5. Process according to Claim 4, wherein perfluorinated aliphatic or cycloaliphatic compounds containing at least 8 carbon atoms are used.

6. Process according to Claim 5, wherein there are used perfluorinated tri-n-butylamine, perfluorinated cycloaliphatic ethers of the formula $C_8F_{16}O$ and perfluorinated hydrocarbons of the formula $C_nF_{2n+2}$, wherein $n = 12$ to 25.

7. A process according to claim 6, wherein there are used perfluorododecane or perfluorodecalin.

8. Process according to claim 1, wherein the ratio of material to liquor is 1:1 to 1:3.

9. Process according to claim 1, wherein the materials are textile materials or leather.

10. Process according to claim 1, wherein the process is a dyeing process, optical brightening process, bleaching process or antistatic-finishing process.

11. Process according to claim 1, wherein polyester materials are dyed from water with the addition of perfluorinated tri-n-butylamine.

12. The liquor for carrying out the process according to Claim 1.

* * * * *